US006222492B1

(12) United States Patent
Mahon

(10) Patent No.: US 6,222,492 B1
(45) Date of Patent: Apr. 24, 2001

(54) DUAL COAXIAL FEED FOR TRACKING ANTENNA

(75) Inventor: John Mahon, Culver City, CA (US)

(73) Assignee: Optim Microwave, Inc., Westlake Village, CA (US)

( * ) Notice: Subject to any disclaimer, the term of this patent is extended or adjusted under 35 U.S.C. 154(b) by 0 days.

(21) Appl. No.: 08/471,309

(22) Filed: May 11, 1995

Related U.S. Application Data

(63) Continuation of application No. 08/239,695, filed on May 9, 1994, now abandoned.

(51) Int. Cl.[7] ..... H01Q 13/02
(52) U.S. Cl. ..... 343/786
(58) Field of Search ..... 343/776, 786; H01Q 13/02, 13/24

(56) References Cited

U.S. PATENT DOCUMENTS 3,665,481 * 5/1972 Low et al. ..... 343/786
3,864,687 * 2/1975 Walters et al. ..... 343/786
4,041,499 * 8/1977 Liu et al. ..... 343/786
4,740,795 * 4/1988 Seavey ..... 343/776

* cited by examiner

*Primary Examiner*—Michael C. Wimer
(74) *Attorney, Agent, or Firm*—Edward A. Sokolski

(57) ABSTRACT

A wide-band feed for a reflector antenna that provides a sum and a difference radiation pattern for tracking and for the transmission or reception of data. The feed utilizes two coaxially located, coaxial waveguides. The inner coaxial waveguide supports propagation of the TE11 mode and produces a sum radiation pattern. The outer coaxial waveguide supports propagation of the TE21 mode and produces a difference radiation pattern. The dimensions of the inner and outer waveguides are selected such that the dispersions of the TE11 mode in the inner coaxial waveguide and the TE21 mode in the outer coaxial waveguide are the same. Coaxial chokes located near the open ends of the wave guide modify the impedance match to free space of the fields within the waveguides and modify the radiation patterns generated by the waveguides. Probes within the waveguides generate the respective modes. Fins located in proximity to the probes operate as cutoff waveguides which terminate the probe end of the waveguides and which modify the impedance of the probes.

4 Claims, 1 Drawing Sheet

DUAL COAXIAL FEED FOR TRACKING ANTENNA

This application is a continuation, of application Ser. No. 08/239,695, filed May 09, 1994, now abandoned.

BACKGROUND OF THE INVENTION

1. Field of the Invention

This invention relates to antennas and antenna feed systems. More particularly, this invention pertains to phase monopulse feeds for tracking antennas that are used for tracking a satellite, aircraft, or other target or source of electromagnetic radiation and that may also be used for transferring data to or from the satellite, target or source.

2. Description of the Prior Art

By appropriate design of the feed for a reflector antenna, the feed, in combination with the reflector, can be constructed so as to produce an antenna radiation pattern in the form of a "sum" pattern. The "sum" pattern can receive electromagnetic energy from the reflector and deliver this energy to the "sum" port of the feed. If properly constructed, the same feed can also provide an antenna radiation pattern in the form of a "difference" pattern or patterns which can receive electromagnetic energy from the reflector and deliver this energy to the "difference" port(s) of the feed.

Many different feed systems have been used for this purpose. For instance, an array of discrete elements such as dipoles, or crossed dipoles, slots or horns have been used for this purpose. See e.g. U.S. Pat. No. 5,025,493. Typically an array of five elements in the form of a cross is used. The center element provides the sum pattern and the four peripheral elements provide the difference patterns. One pair of opposing peripheral elements provides a difference pattern that may be used for tracking in one plane. The second pair of opposing peripheral elements provides a second difference pattern oriented at right angles to the first and which may be used for tracking in a second plane, orthogonal to the first. Many other variations of these feed systems have been used for tracking. For example, the right dipole may be "turned off" and the top, bottom and left dipoles excited appropriately to cause the peak of the radiation pattern to be squinted to the left. By appropriate choice of the elements and their excitation, the radiation pattern generated by the feed may be made right-hand or left-hand circularly polarized. If the output from the first difference port is shifted in phase by 90 degrees and combined with the output from the second difference port, the combination may be received from a single "circularly polarized" difference port.

The angular orientation of the radiation pattern generated by the feed system may be altered by various methods, one of the well known methods is the "rho-theta" scanning technique which is described in Y. Choung, K. Goudey, L. Bryans, "Theory and Design of a Ku-Band TE21 Mode Coupler", IEEE Trans. MTT Vol. 30, No. 11, Pg. 1862–1866, November 1982. By appropriate combination of the signals from the circularly polarized sum and difference ports, the peak of the radiation pattern can be made to squint away from the Z axis if a relative phase shift is added to the signal output from the sum or the difference port. If the relative phase shift is varied with time in a predetermined manner, the resultant variations in the output of the combined sum and difference ports may be used to track the target or source.

Another phase mechanism also affects the location of the beam. This phase mechanism is the relative phase of the sum and difference patterns on the Z axis. Ideally the phase difference between these two patterns is a constant over the whole operating band. If the phase difference is constant and if the phase shift introduced by the phase shifter is also constant over the same frequency range, then the peak of the radiation pattern will remain at the same angular coordinate over the entire frequency range. However, if the phase between the radiation patterns varies with frequency, then the phase shift introduced by the phase shifter must be adjusted at each operating frequency in order to keep the radiation pattern pointed in the same direction. As a consequence, for the rho-theta technique to be used in a broadband tracking antenna, it is preferable that the phase relationship between the sum channel radiation pattern and the difference channel radiation pattern on axis be essentially constant over the entire band of frequencies overwhich the feed system is to operate. This constancy of phase simplifies the logic necessary to determine the relationship between the setting of the phase shifter and the position of the peak of the pattern.

Unfortunately, when operated over a wide bandwidth, the performance of a feed consisting of a discrete array of elements degrades substantially because the mutual coupling between the discrete elements varies with the changes in frequency. As a consequence, one or more performance parameters, such as aperture efficiency, sidelobe level, cross talk, boresight shift, error-slope linearity or axial ratio, are significantly degraded.

The combination of a circular waveguide with a coaxially located coaxial waveguide has also been used to provide a sum and difference pattern. Such a design was described in "Dual Band EHF Autotrack Feed", 1990 International Telemetering Coference Proceedings, Volume XXVI, Pg. 241–246. Unfortunately, the phase velocity of the wave within the circular waveguide varies with changes in frequency in a different manner than the variation in phase velocity in the coaxial waveguide. This difference in dispersion substantially degrades the tracking performance of the antenna or conversely requires extension compensation to counteract this effect.

BRIEF SUMMARY OF THE INVENTION

The present invention utilizes two concentric coaxial waveguides. The TE11 mode propagating in the inner coaxial waveguide provides the "sum" radiation pattern and the TE21 mode propagating in the outer coaxial waveguide provides the "difference" radiation pattern. The mid-radii of the inner and outer coaxial waveguides are selected so that the dispersion of the TE11 mode is the same as the dispersion of the TE21 mode. The two coaxial waveguides exhibit phase velocities which vary in the same manner with frequency, i.e. they provide the same dispersion. As a consequence, the phase difference between the sum and difference patterns at boresight can be kept nearly constant.

Circular chokes, which are located near the open ends of the coaxial waveguides, modify and improve the radiation patterns generated by the feed.

By using a pair of waves propagating in the TE11 propagation mode in the center coaxial waveguide and a pair of waves propagating in the TE21 propagation mode in the outer coaxial waveguide the device can provide either right or left-hand circularly polarized radiation patterns.

In the preferred embodiment, electromagnetic waves from free space are reflected by a reflector so as to impinge upon the open end of the two concentric, coaxial waveguides, or conversely, energy radiated from the open end of the waveguides is reflected by the reflector into free space.

Accordingly, it should be understood that references in the claims to energy received from free space are intended also to include energy that is reflected by a reflector from free space to the open end of the waveguides. It should also be understood that the feed system may be used both for receiving energy from free space and for transmitting energy to free space. Accordingly, the claims should be understood to encompass the reception of energy or the transmission of energy, or both.

DETAILED DESCRIPTION OF THE INVENTION

Figure 1:
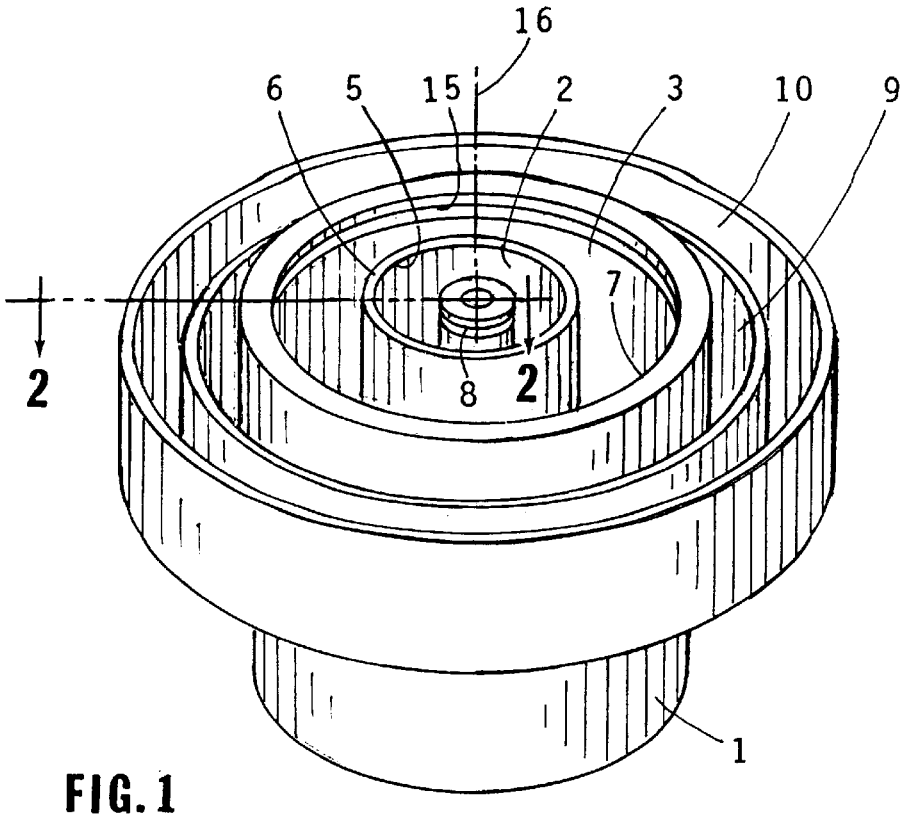
FIG. 1 is a perspective view of the feed.
Figure 2:
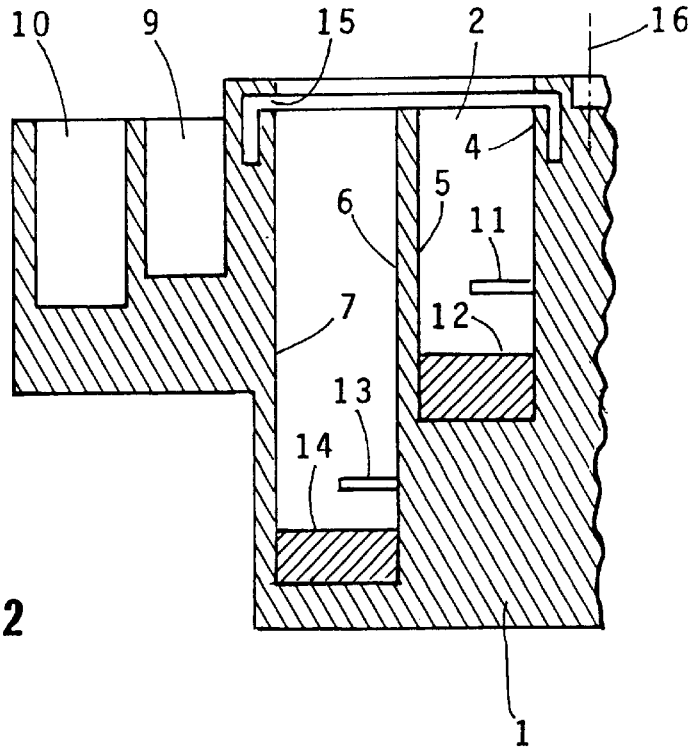
FIG. 2 is a cross-sectional view of the feed.

A partial cross-sectional view of feed 1 is depicted in FIG. 2. The basic structure of feed 1 is rotationally symmetric about centerline 16. Electromagnetic energy propagates in the TE11 mode within inner coaxial waveguide 2 bounded by cylindrical conducting surfaces 4 and 5. Electromagnetic energy propagates in the TE21 mode within outer coaxial waveguide 3 bounded by cylindrical conducting surfaces 6 and 7. Cylindrical chokes 8 and 15 are used to improve the impedance matches between the free space and waveguides 2 and 3. Cylindrical chokes 9 and 10 that are located near the open end of waveguide 3 modify the impedance matches between free space and coaxial waveguides 2 and 3 and also modify the radiation patterns in free space that are generated by the fields at the open ends of waveguides 2 and 3.

The TE11 mode in waveguide 2 produces the "sum" pattern and the TE21 mode in waveguide 3 produces the "difference" pattern. An orthogonal pair of TE11 modes in waveguide 2 may be used to produce a circularly polarized sum pattern and similarly, an orthogonal pair of TE21 modes in waveguide 3 may be used to produce a circularly polarized difference pattern.

By judicious selection of the mid-radii of waveguide 2 and waveguide 3 the dispersion of the TE11 mode in waveguide 2 can be made equal to the dispersion of the TE21 mode in waveguide 3, thus significantly simplifying the design of tracking system using this feed because the phase relationship between the sum and difference patterns remains relatively constant over a wide bandwidth. Although the exact relationship between the mid-radii is affected by the various dimensions of the feed system, the ratio of the mid-radii is roughly 2 to 1.

In the preferred embodiment, the orthogonal pair of TE11 modes is generated in waveguide 2 by a set of four probes 11 symmetrically located at 90 degree increments in waveguide 2. One probe 11 and a second probe 11 that is located on the opposite side of waveguide 2 are fed in phase opposition to generate one TE11 mode. (Note that because of the rotational symmetry, the first probe is physically inverted relative to the second probe that is located opposite to the first.) The remaining pair of probes 11, that lie at 90 degree angles to the first and second probes, are fed in phase opposition to each other to generate the second TE11 mode in waveguide 2. If one of the two orthogonal pairs of probes 11 are fed with an additional 90 degree phase shift, the combination of the four probes produces a left or right hand circularly polarized wave in freespace. The probes act as coupling devices to couple energy between a sum or difference ports and the respective modes propagating within the waveguide.

It should be understood that dipoles or other devices may instead be used for coupling energy between the sum port and the waves propagating within waveguide 2. These coupling devices may be referred to herein as "exciters". The combination of probes, dipoles or other devices that are used to couple energy between the sum port and the wave or waves propagating within waveguide 2 may, in the aggregate, be referred to as the coupling device. Four fins 12, which are located to the left of probes 11, divide the left most portion of waveguide 2 into four "quadrant" waveguides. The dimension of each quadrant waveguide is sufficiently small such that the TE11 mode will not propagate within the quadrant waveguide, i.e. the quadrant waveguide is "beyond cutoff". The proximity of fins 12 to probes 11 is adjusted so as to obtain the best performance of the probes over the bandwidth of operation.

In a similar fashion, an orthogonal pair of TE21 modes is generated by eight probes 13 symmetrically located at 45 degree increments in waveguide 3. A first set of four probes 13 that lie at 90 degree increments to each other excite one TE21 mode and the remaining, second set of 4 probes 13 excite the second TE21 mode. The two sets of probes are interleaved. Alternate probes in each set are fed in phase opposition to each other to generate the TE21 modes. In a similar fashion the combination of probes, dipoles or other devices that are used to couple energy between the difference port and the wave or waves propagating within waveguide 3 may, in the aggregate, be referred to as the coupling device. Eight fins 14, which are located to the left of probes 13, divide the left most portion of waveguide 3 into 8 "octant" waveguides. The dimension of each octant waveguide is sufficiently small such that the TE21 mode will not propagate within the octant waveguide. Similarly, the proximity of fins 14 to probes 13 is adjusted to obtain the best performance of probes 13 over the bandwidth of operation.

The appropriate dimensions for the feed for a particular application may be obtained by Numerical analysis of the feed using Schelkunoff's equivalence theorem to break the analysis of the complex geometry into the analysis of a number of simpler geometries. Equivalent magnetic and electric currents are placed on the interfaces between the sets of simpler geometries. The boundary conditions for the simpler geometries and the commonality of the currents allow the formation of a set of integral equations of the unknown currents. These integral equations are solved by application of the Galerkin method of moments. Techniques for such analysis are described in R. F. Harrington, Field Computation by Moment Methods, IEEE Press, 1993 and computer software programs for the analysis of rotationally symmetric feed systems are well known in the art.

I claim:

1. In a tracking antenna of the type having a feed for receiving electromagnetic energy from free space, the feed having a sum port and a difference port, the feed comprising, a first coaxial waveguide having an input end and an output end, said waveguide being bounded longitudinally by an inner conducting surface and by an outer conducting surface, and a second coaxial waveguide having an input end and an output end, said second waveguide being bounded longitudinally by an inner conducting surface and by an outer conducting surface, the first coaxial waveguide being located inside of and coaxially with the second coaxial waveguide, the first coaxial waveguide having an opening at its input end, the opening allowing electromagnetic energy to pass from free space into and propagate within the first coaxial waveguide, said electromagnetic energy propagating within the first coaxial waveguide in the TE11 mode, the TE11 mode having a dispersion, the second coaxial waveguide having an opening at its input end, the opening allowing electromagnetic energy to pass from free space into and propagate within the second coaxial waveguide, said electromagnetic energy propagating within the second coaxial waveguide in the TE21 mode; the TE21 mode having a dispersion, the dimensions of the first coaxial waveguide and the dimensions of the second coaxial waveguide being selected such that the dispersion of the TE11 mode in the first coaxial waveguide is approximately the same as the dispersion of the TE21 mode in the second coaxial waveguide, the first coaxial waveguide having a first coupling device connected to its output end, the first coupling device coupling energy between the sum port and electromagnetic energy propagating within the first coaxial waveguide, the second coaxial waveguide having a second coupling device connected to its output end, the second coupling device coupling energy between the difference port and electromagnetic energy propagating within the second coaxial waveguide, whereby the first coaxial waveguide provides a sum electromagnetic radiation pattern with respect to the electromagnetic radiation received from free space and the second coaxial waveguide provides a difference electromagnetic radiation pattern with respect to the electromagnetic radiation received from free space.

2. The device of claim 1 wherein the first coupling device comprises at least four exciters located in a circularly symmetric pattern within the first coaxial waveguide near the output end of the first waveguide, the output end of the first waveguide further including a plurality of fins oriented within the first waveguide so as to form a plurality of cutoff waveguides that terminate the output end of the first waveguide and modify the characteristics of the exciters, and wherein the second coupling device comprises at least eight exciters located in a circularly symmetric pattern within the second coaxial waveguide, the output end of the second waveguide further including a plurality of fins oriented within the waveguide so as to form a plurality of cutoff waveguides that terminate the output end of the second waveguide and modify the characteristics of the exciters.

3. The device of claim 1 and further comprising at least one coaxial choke ring located adjacent to the input end of the first or second coaxial waveguides, whereby the coaxial choke ring modifies the shape of the sum or difference pattern provided by the first or second coaxial waveguide.

4. The device of claim 2 and further comprising at least one coaxial choke ring located adjacent to the input end of the first or second coaxial waveguides, whereby the coaxial choke ring modifies the shape of the sum or difference pattern provided by the first or second coaxial waveguide.

* * * * *